United States Patent [19]

Herren

[11] 4,418,485

[45] Dec. 6, 1983

[54] SNOWBLOWER GEARBOX ASSEMBLY

[75] Inventor: Kenneth E. Herren, Beaver Dam, Wis.

[73] Assignee: Deere & Company, Moline, Ill.

[21] Appl. No.: 362,732

[22] Filed: Mar. 29, 1982

[51] Int. Cl.[3] ..... E01H 5/09

[52] U.S. Cl. ..... 37/244; 74/11

[58] Field of Search ..... 37/242, 243, 244, 246–259, 37/209–212, 205–206; 74/11

[56] References Cited

U.S. PATENT DOCUMENTS

| | | | |
|---|---|---|---|
| 1,561,111 | 11/1925 | Rittenhouse | 37/247 X |
| 2,152,860 | 4/1939 | Behrens et al. | 37/248 |
| 2,269,326 | 1/1942 | Wandscheer | 37/248 |
| 2,381,017 | 8/1945 | Wandscheer | 37/248 |
| 2,815,590 | 12/1957 | Fiacco | 37/248 |
| 2,858,625 | 11/1958 | Rivinius | 37/247 X |
| 3,318,027 | 5/1967 | McNeal | 37/248 |
| 3,780,455 | 12/1973 | Stevenson et al. . | |

*Primary Examiner*—E. H. Eickholt

[57] ABSTRACT

A snowblower housing containing a scraper and impeller has a plurality of mounting stations located on the rear wall. A gearbox is mounted at one of the stations having its output shaft in communication with the impeller and scraper. The gearbox is mounted detachably so that it can be repositioned between any one of the plurality of mounting stations by rotating the gear box about the output shaft. The gear box is generally comprised of a casing having first and second casing halves detachably mounted to each other and defining an enclosed chamber. Rotatably mounted in the casing is an input shaft carrying an enclosed gear. The output shaft is rotatably mounted in the casing, carrying an enclosed second gear. The gear box further contains a plurality of colinearly aligned bores for the mounting of a countershaft and associated gear for providing a means of communicating the first gear with the second gear.

2 Claims, 8 Drawing Figures

SNOWBLOWER GEARBOX ASSEMBLY

BACKGROUND OF THE INVENTION

This invention relates to snowblowers, and more particularly to tractor-powered snowblowers.

Conventionally, a tractor will have the capability for the attachment of a snowblower on the forward or rear end of the tractor utilizing a hitch system. The tractor will also have a power take-off (PTO) system for providing operating power to the snowblower through a PTO shaft. Snowblowers are generally designed to operate in conjunction with a particular tractor or relatively small family of tractors because of differences in the operating characteristic between different families of tractors.

One difference between tractor families is size. A snowblower is generally designed to have a complimentary size to the tractor size, to minimize the angle assumed by the communicating PTO shaft. The benefit derived from minimizing the angle of the PTO shaft is a reduction in chatter of the snowblower during operation. Another difference between tractor families is the speed at which the PTO system operates. As a result, the snowblower will have a complimenting internal gearing in view of the particular tractor famility it is intended to operate with to produce optimum through-put. That is, because optimum snowblower through-put is generally achieved at a snowblower operating speed different from the tractor's PTO system speed, the snowblower gearing is particularly matched to PTO speed.

SUMMARY OF THE INVENTION

It is an object of the present invention to present a means by which a snowblower can be mated to a variety of tractor families.

The snowblower includes a housing rotatably supporting therein a collector and impeller. The rear section of the housing contains a plurality of mounting stations. A gearbox is detachably mounted at one of the stations. The output shaft of the gearbox is in communication with the collector and impeller of the snowblower. The input shaft of the gearbox is in communication with the PTO shaft of a tractor.

The gearbox can be repositioned to any one of the plurality of mounting stations. As a result of repositioning the gearbox, the relative vertical position of the input shaft of the gearbox to the associated tractor's PTO system can be adjusted. The gearbox internally contains a plurality of additional mounting locations for the placement of countershaft and associated gears. By varying the internal gear relative location between the input shaft, output shaft, and countershaft gear, one can achieve a uniform output rotational speed and direction of the gear box notwithstanding variations in the tractor's PTO system's speed and direction of rotation.

DETAILED DESCRIPTION OF THE PREFERRED EMBODIMENT

Figure 2:
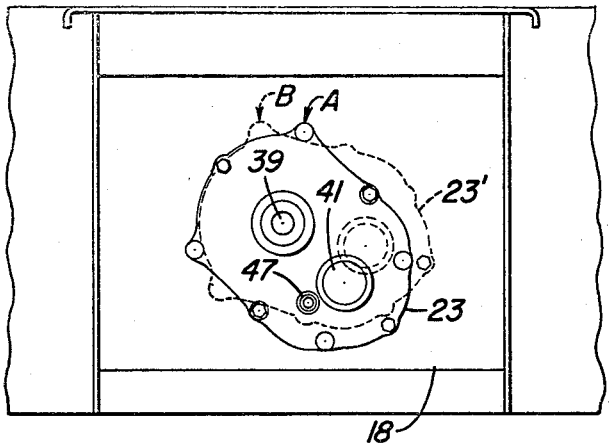
FIG. 2 shows a partial elevated view of the rear section of a snowblower housing.
Figure 1:
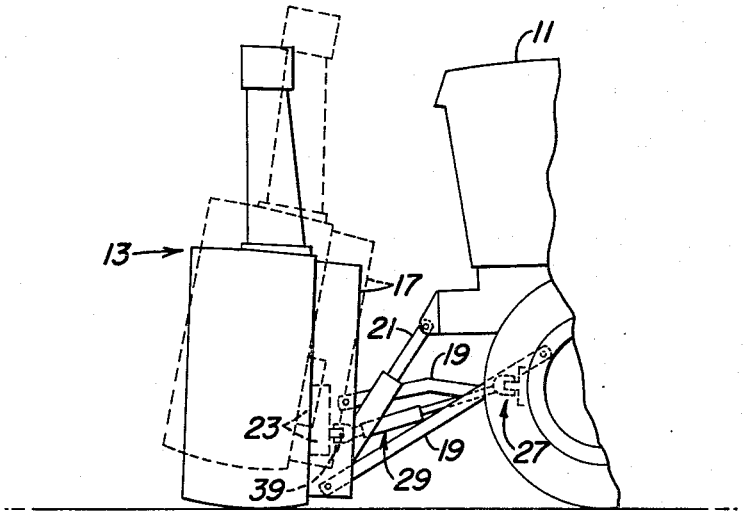
FIG. 1 shows a partial schematic elevated view of a forward section of a tractor and mounted snowblower.

Referring to FIGS. 1 and 2, the forward section of a tractor generally indicated as 11, has a snowblower 13 mounted to the tractor forward section 11 by hitch arms 19 by any conventional manner. The snowblower 13 is of conventional design containing a collector and impeller. A hydraulic cylinder 21 is pivotally mounted by any conventional manner to the forward end of the tractor 11 and the snowblower housing 17 for raising and lowering the snowblower 13. A gearbox 23 is fixably and detachably mounted to the rear wall 18 of the housing 17 for communication with the tractor PTO 27. A double articulated PTO shaft 29 communicates the tractor's PTO system 27 to the input of a gearbox 23 at 41 in a conventional manner.

Figure 3A:
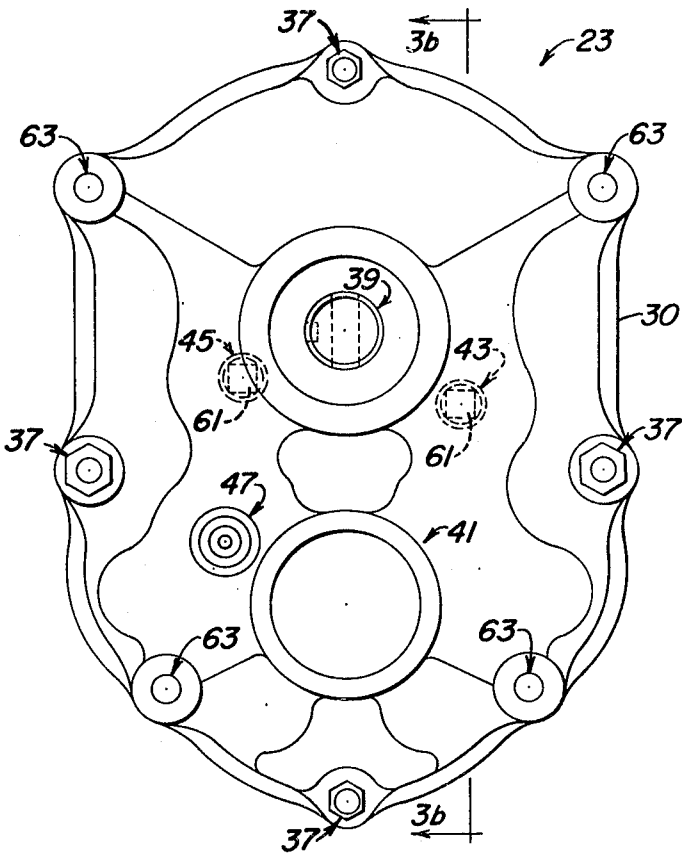
FIG. 3*a* is a frontal view of the gearbox.
Figure 3B:
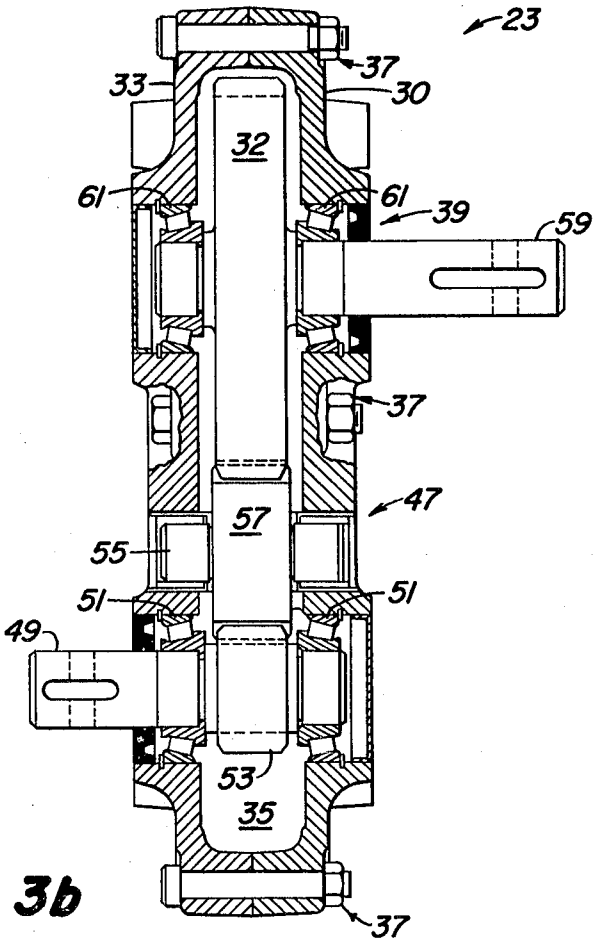
FIG. 3*b* is a sectioned side view of a gearbox along line B—B.

Referring to FIGS. 2, 3*a* and 3*b*, the gearbox 23 is fixably and detachably mounted by any conventional means such as by nut and bolt arrangement to the rear wall 18 of the snowblower housing 13 at one of a plurality of mounting stations A or B (mounting of the gearbox 23 at station B being shown in phantom). The gearbox 23 is comprised of a casing formed by first and second casing sections 30 and 33 respectively fixedy and detachable mounted to each other by any conventional means such as by bolt and nut arrangements 37. The casting sections 30 and 33 when mounted define an enclosed chamber 35. Rotatably mounted in the casing by any conventional means is an output shaft 59 at 39. The output shaft 59 has fixably and detachably mounted therearound, a gear 32 located within the chamber 35. An input shaft 49 is rotatably mounted within the casing at 41 by any conventional means and has fixably and detachably mounted therearound a gear 53 located within the chamber 35. For communicating the gear 32 with the gear 53, a countershaft 55 is rotatably and detachably mounted in the gearbox 23 at 47 and has fixably and detachably mounted therearound a gear 57 in constant mesh with the gears 32 and 51.

The casing provides a plurality of additional shaft mounting locations 43, and 45, which can be used to relocate the countershaft 55 and gear 57. When the shaft mounting locations 43, 45 and 47 are not in use, a conventional plug 61, can be fixably and detachably mounted in said casing 23 at locations 43, 45, 47 to prevent foreign objects from entering the casing.

Figure 4B:
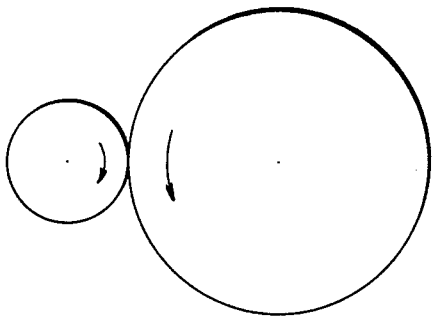
FIGS. 4*a* through 4*d* show schematically varying locations of the gear arrangement within the gearbox.
Figure 4A:
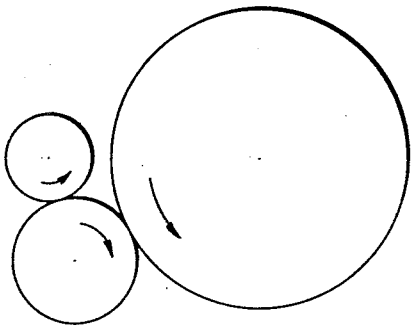
Figure 4D:
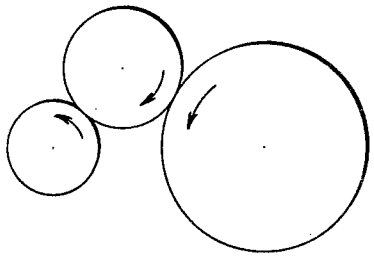
Figure 4C:
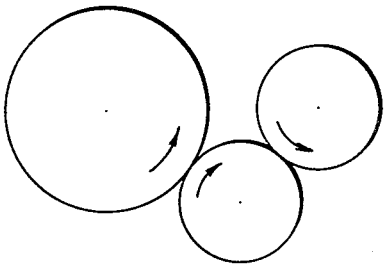

Referring to FIGS. 4*a* through 4*c*, it is observed that various combinations of countershaft and gear sizes permits a varition of input shaft speed and rotational direction to a given speed and rotational direction of the output shaft. Further, the ability to position the gear box 23 at any one of a variety of locations allows an optimum relationship between the gear box input shaft and PTO tractor location to minimize chatter related with the PTO shaft 29.

I claim:

1. In combination, a snowblower having a housing containing a rotatably mounted collector and impeller and gear box drivingly communicating with said collector and impeller, said gear box comprising a casing having at least a first and second section fixably and detachably mounted to each other defining a chamber, said housing having a rear wall containing a plurality of mounting stations mating to said casing such that said casing can be fixably and detachably mounted to any one of said mounting stations, an input shaft rotatably mounted in said casing having a portion extending therefrom and carrying a fixably and detachably mounted first gear within said chamber, an output shaft rotatably mounted in said casing having a portion extending therefrom in driving communication with said collector and impeller, said output shaft carrying a fixably and detachably mounted second gear in driven communication with said first gear.

2. In a combination as recited in claim 1 wherein said gear box further comprises a plurality of shaft mount locations wherein said input shaft and output shaft relative position can be altered.

* * * * *